US012759750B2

(12) United States Patent
Hsu

(10) Patent No.: US 12,759,750 B2
(45) Date of Patent: Oct. 13, 2026

(54) ENVIRONMENTALLY FRIENDLY FRESH-KEEPING CAN AND METHOD OF MANUFACTURING THE SAME

(71) Applicant: Yu-Ting Hsu, Taipei City (TW)

(72) Inventor: Yu-Ting Hsu, Taipei City (TW)

( * ) Notice: Subject to any disclaimer, the term of this patent is extended or adjusted under 35 U.S.C. 154(b) by 0 days.

(21) Appl. No.: 18/884,414

(22) Filed: Sep. 13, 2024

(65) Prior Publication Data

US 2026/0035126 A1 Feb. 5, 2026

(30) Foreign Application Priority Data

Aug. 5, 2024 (TW) ..... 113129246

(51) Int. Cl.

| | |
|---|---|
| ***B65D 3/22*** | (2006.01) |
| ***B65D 3/04*** | (2006.01) |
| ***B65D 3/26*** | (2006.01) |
| ***B65D 43/02*** | (2006.01) |
| ***B65D 85/72*** | (2006.01) |

(52) U.S. Cl.

CPC ..... *B65D 3/22* (2013.01); *B65D 3/04* (2013.01); *B65D 3/268* (2013.01); *B65D 43/0235* (2013.01); *B65D 85/72* (2013.01); *B65D 2401/15* (2020.05); *B65D 2565/382* (2013.01); *B65D 2565/385* (2013.01)

(58) Field of Classification Search

CPC . B65D 3/22; B65D 3/04; B65D 3/268; B65D 43/0235; B65D 85/72; B65D 2401/15; B65D 2565/382; B65D 2665/385; B65D 15/04; B65D 17/4012; B65D 2517/0014; B65D 65/466; B65D 15/08; B65D 25/14; B65D 23/02; Y02W 90/10; B32B 2439/70; B32B 2439/66; B32B 27/10

USPC ..... 229/5.81, 4.5, 123.2; 138/144; 206/524.2, 830; 220/260, 62.12, DIG. 30; 426/127; 428/222

See application file for complete search history.

(56) References Cited

U.S. PATENT DOCUMENTS 4,181,239 A * 1/1980 Heiremans ..... B32B 27/08 220/62.12
5,738,921 A * 4/1998 Andersen ..... B29C 67/202 428/36.1
12,421,006 B2 * 9/2025 Hofmann ..... B65D 77/06
(Continued)

*Primary Examiner* — Christopher R Demeree
(74) *Attorney, Agent, or Firm* — LANWAY IPR SERVICES; Chun-Ming Shih

(57) ABSTRACT

An environmentally friendly fresh-keeping can and a method of manufacturing the same are provided. The environmentally friendly fresh-keeping can includes a housing, an inner container, an easy-open lid, and a bottom cover. The housing, the inner container, the easy-open lid, and the bottom cover are respectively made of a spiral paper tube, bio-based polyethylene 2,5-furanoate (PEF), aluminum, and biodegradable plastic. The inner container is mounted into the housing through an inner opening on a top of the inner container. Then the easy-open lid and the bottom cover are respectively used to seal the inner opening of the inner container and a bottom opening of the housing. The respective components are made of biodegradable, recyclable and reusable materials and able to be disassembled for recycling and reuse. Thereby the can meets requirements for environmental protection and recycling.

13 Claims, 5 Drawing Sheets

(56) References Cited

U.S. PATENT DOCUMENTS

| | | | | |
|---|---|---|---|---|
| 12,534,263 | B2 * | 1/2026 | Schönig | B65D 3/14 |
| 2025/0304328 | A1 * | 10/2025 | Hsu | B65D 35/10 |

* cited by examiner

ENVIRONMENTALLY FRIENDLY FRESH-KEEPING CAN AND METHOD OF MANUFACTURING THE SAME

FIELD OF THE INVENTION

The present invention relates to a can and a method of manufacturing the same, especially to an environmentally friendly fresh-keeping can and a method of manufacturing the same.

BACKGROUND OF THE INVENTION

In order to solve environmental problems caused by plastic bottles made of polyethylene terephthalate (PET) (unable to be degraded naturally), containers made from naturally-degradable materials have been developed and mass-produced for use. For example, manufacturers in America, England, Holland, Denmark, etc. have proposed paper bottles produced by one-piece forming technology. Although such paper bottles can be produced fast and conveniently, their structural strength and compression strength are still insufficient. Thus the paper bottles can't be used for carbonated drinks or other pressurized beverages or liquid (such as sparkling water). Glass bottles or metal cans are commonly-used containers for storage of foods or ingredients. Although the glass bottles can be recycled and reused, they are easy to get shattered and unable to isolate sunlight or UV light. As to the metal can, it is usually made of tinplate and a tin layer on an inner surface of the can is mainly used as a protective layer to avoid iron corrosion caused by food. The tin layer also prevents the food from spoiling by isolating it from environmental factors. Yet the metal can is easily deformed or compressed due to an external force applied and food storage or freshness preserving function is further affected.

In practice, in order to comply with increasingly stringent environmental regulations and industry standards, such kind of containers made from biodegradable or recyclable materials (such as paper bottles) should meet the following requirements. By priority, the first is that all components can be recycled and reused. The second is using bio-based materials to produce the products. The third is the products should be bio-decomposable or bio-degradable.

Most of so-called biodegradable or recyclable environmentally friendly containers available now are made from biodegradable ore recyclable/reusable materials. But respective components of these environmentally friendly containers are usually difficult to be broken down or detached for sorting and recycling separately. Thus completely recycling of these containers is unable to be achieved.

SUMMARY

Therefore, it is a primary object of the present invention to provide an environmentally friendly fresh-keeping can which is able to be recycled completely, having solid structure, and giving waterproof and airtight functions and a method of manufacturing the same. Thus the can is suitable for storage of food or material due to good fresh-keeping function.

In order to achieve the above object, an environmentally friendly fresh-keeping can according to the present invention includes a housing, an inner container, an easy-open lid, and a bottom cover. The housing is formed by a spiral paper tube. A top opening and a bottom opening are respectively formed on a top end and a bottom end of the housing. A first connection portion is arranged at an inner wall surface of the housing. The inner container which is a waterproof container is mounted into the housing and is composed of a tubular side wall, a bottom surface located at a bottom of the side wall and integrally connected to the side wall, an inner opening formed on a top end of the side wall and provided with a flange projecting outward, and a second connection portion disposed on an outer wall surface of the side wall and used for connection with the first connection portion. The flange is at a higher level than the top opening of the housing. The easy-open lid made of aluminum is for closing or opening the inner opening and is provided with an aluminum lid, an open plate, and a pull-tab. A circular skirt is formed at a periphery of the aluminum lid for covering the flange of the inner container. Thus the easy-open lid is assembled with the inner container to seal the inner opening. The aluminum lid further includes an opening which is normally closed by the open plate. The pull-tab is connected to one end of the open plate. While being pulled by an external force, the pull-tab drives the open plate to come off from the aluminum lid so that the opening is exposed. The bottom cover is made of biodegradable plastic by injection molding and able to be detachably connected to the bottom opening of the housing.

A method of manufacturing an environmentally friendly fresh-keeping can includes the following steps. First preparing an easy-open lid which is made of aluminum and composed of an aluminum lid, an open plate, and a pull-tab. A periphery of the aluminum lid is provided with a circular skirt. Then preparing a housing formed by a spiral paper tube and provided with a top opening and a bottom opening respectively arranged at a top end and a bottom end of the housing. An inner wall surface of the housing is provided with a first connection portion. Next using biodegradable plastic to prepare a bottom cover. Later using bio-based polyethylene 2,5-furanoate (PEF) to produce an inner container by blow molding. The inner container includes a tubular side wall, a bottom surface located at a bottom of the side wall and integrally connected to the side wall, an inner opening formed on a top end of the side wall and provided with a flange projecting outward, and a second connection portion disposed on an outer wall surface of the side wall and used for connection with the first connection portion. Then mounting the inner container into the housing and the flange is at a higher level than the top opening of the housing. The first connection portion of the housing and the second connection portion of the inner container are connected with each other. Detachably connecting the bottom cover to the bottom opening of the housing for sealing the bottom opening. Lastly covering the flange of the inner container with the circular skirt of the easy-open lid so that the easy-open lid is assembled with the inner container to seal the inner opening.

Preferably, the spiral paper tube used as the housing is produced by waterproof paper being wound spirally.

Preferably, the waterproof paper is formed by at least two layers of fiber paper and provided with a waterproof layer disposed on a surface of the waterproof paper and located at the inner wall surface of the spiral paper tube.

Preferably, fiber extension directions of the two layers of fiber paper cross each other.

Preferably, the first connection portion and the second connection portion are threads.

Preferably, the bottom cover consists of a bottom plate and a circular wall arranged at a periphery of the bottom plate. The circular wall is composed of an inner wall and an outer wall. A bottom of the inner wall and a bottom of the outer wall are integrated into one part. A radial section of the circular wall is U-shaped and a gap is formed between the inner wall and the outer wall for allowing the bottom end of the housing to insert and in the gap.

The environmentally friendly fresh-keeping can and the method of manufacturing the same of the present invention has the following advantages. The respective components of the environmentally friendly fresh-keeping can are produced by biodegradable, recyclable and reusable materials and able to be disassembled and recycled and thus completely meeting requirements for recycling and reuse. Moreover, the environmentally friendly fresh-keeping can has solid structure, waterproof and airtight functions, applications in food or ingredient storage, and good fresh-keeping effect.

DETAILED DESCRIPTION

In the following descriptions and embodiments in figures according to the present invention, directions mentioned (such as upper, lower, left, right, front and rear) are defined according to related figures and used for showing structure or relationship (such as positions, connections, and actions) among respective components. In principle, the directions described are proper when positions of the components or the structure mentioned in the specifications matches those in figures. Once the positions of the components or the structure mentioned in the specifications change, the directions described should have corresponding changes.

Figure 1:
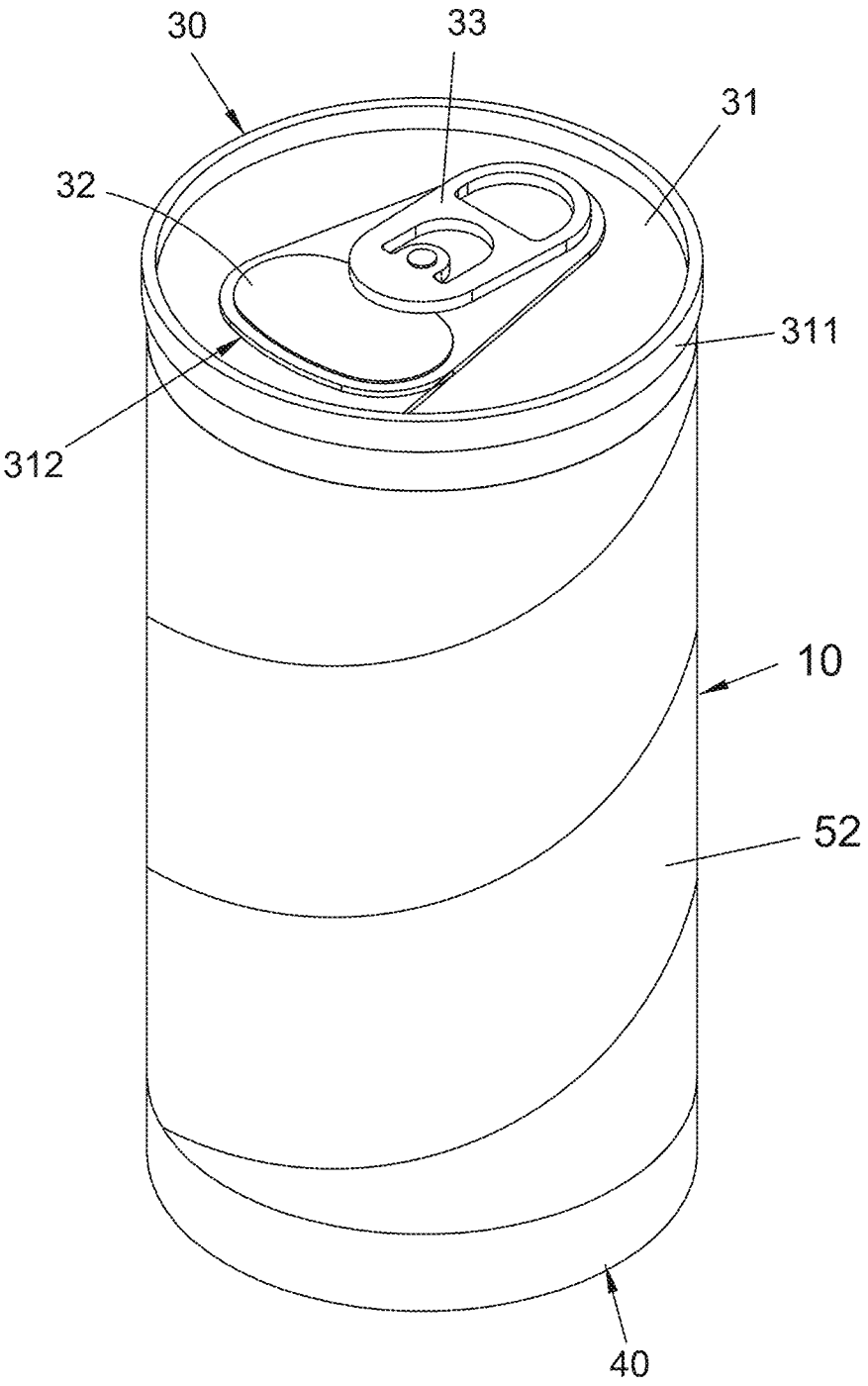
FIG. 1 is a perspective view of an embodiment according to the present invention.
Figure 2:
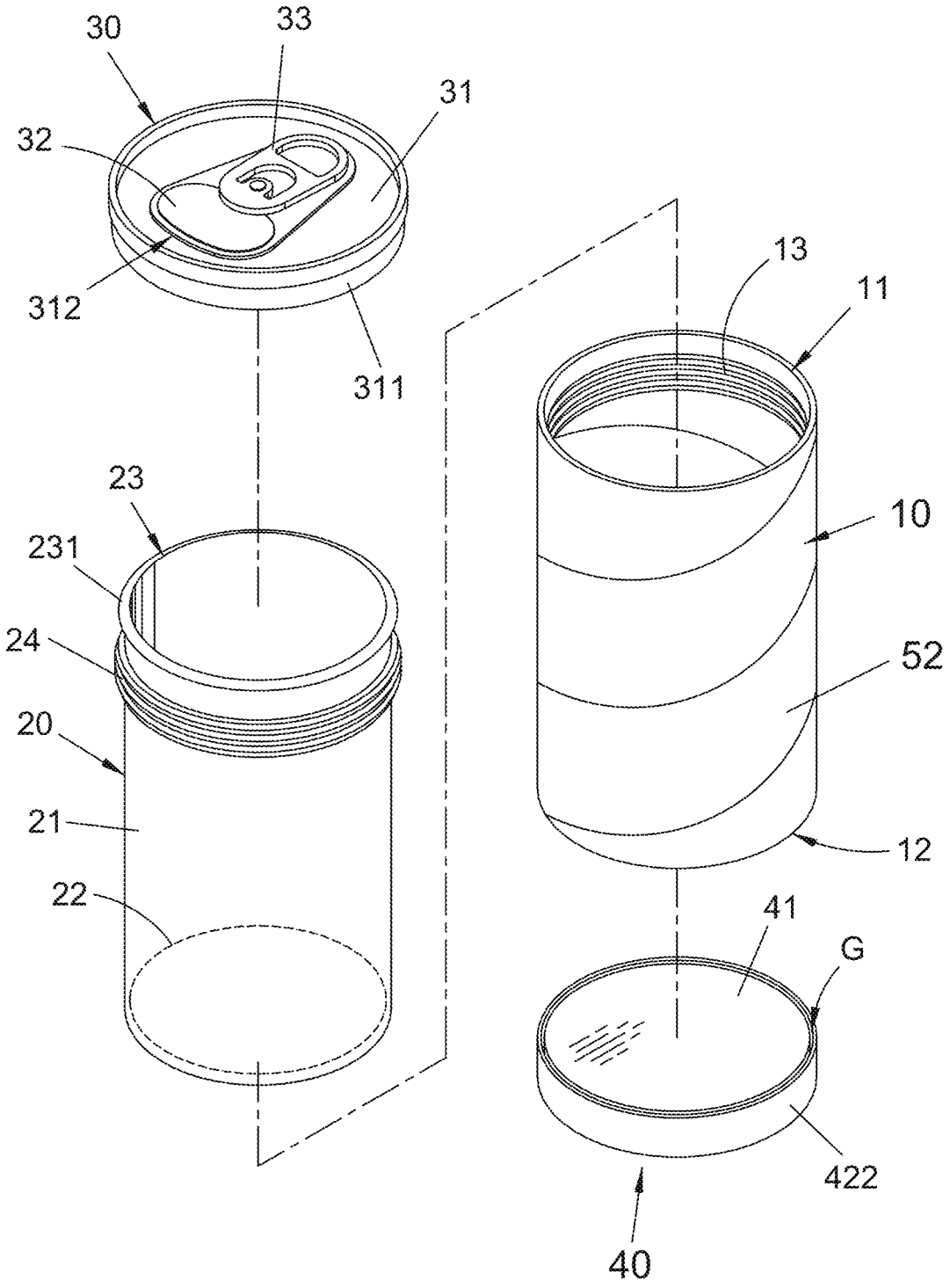
FIG. 2 is an exploded view of an embodiment according to the present invention.

Refer to FIG. 1 and FIG. 2, an environmentally friendly fresh-keeping can according to the present invention includes a housing 10, an inner container 20, an easy-open lid 30, and a bottom cover 40.

Figure 5:
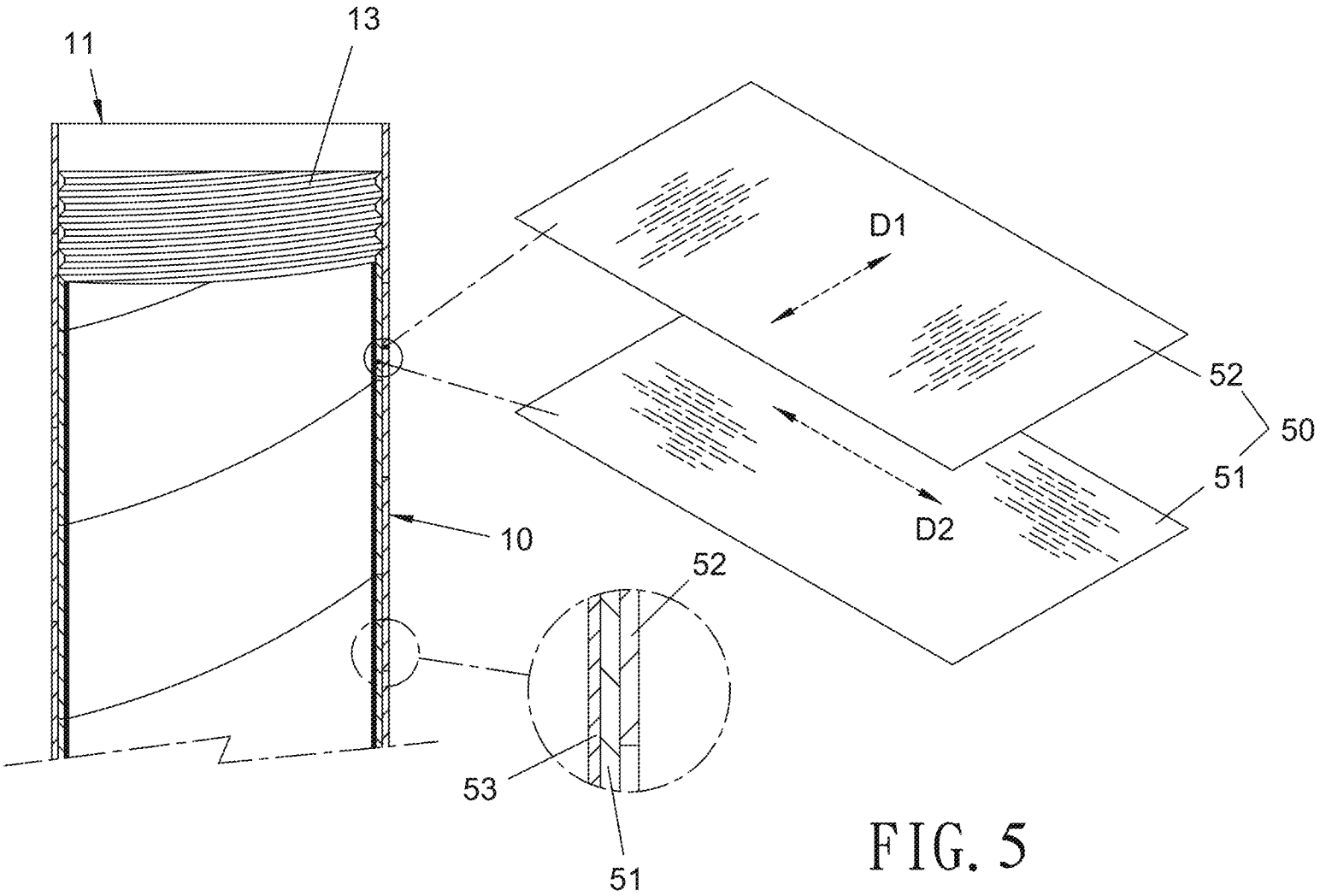
FIG. 5 is a partial sectional view of an embodiment showing fiber extension directions of two layers of fiber paper according to the present invention.

The housing 10 is formed by a spiral paper tube. A top opening 11 and a bottom opening 12 are respectively formed on a top end and a bottom end of the housing 10. A first connection portion 13 is arranged at an inner wall surface of the housing 10. In a preferred embodiment, the spiral paper tube is formed by waterproof paper 50 being wound spirally (as shown in FIG. 5). Refer to FIG. 5, the waterproof paper 50 is made of fiber paper with sufficient structural strength which is provided by a wealthy amount of the fiber structure in the fiber paper. The waterproof paper 50 is formed by at least two layers of fiber paper 51, 52 whose fiber extension directions D1, D2 cross each other. The two layers of fiber paper 51, 52 are overlapped with and attached to each other to increase the structural strength. A waterproof layer 53 is disposed on a surface of the waterproof paper 50 and located at the inner wall surface of the spiral paper tube (as shown in FIG. 5). In a preferred embodiment, the waterproof layer 53 is made of biodegradable material such as polylactic acid (PLA) coated on the surface of the waterproof paper 50 to increase waterproofness of the housing 10 and meet environmental requirements.

Figure 3:
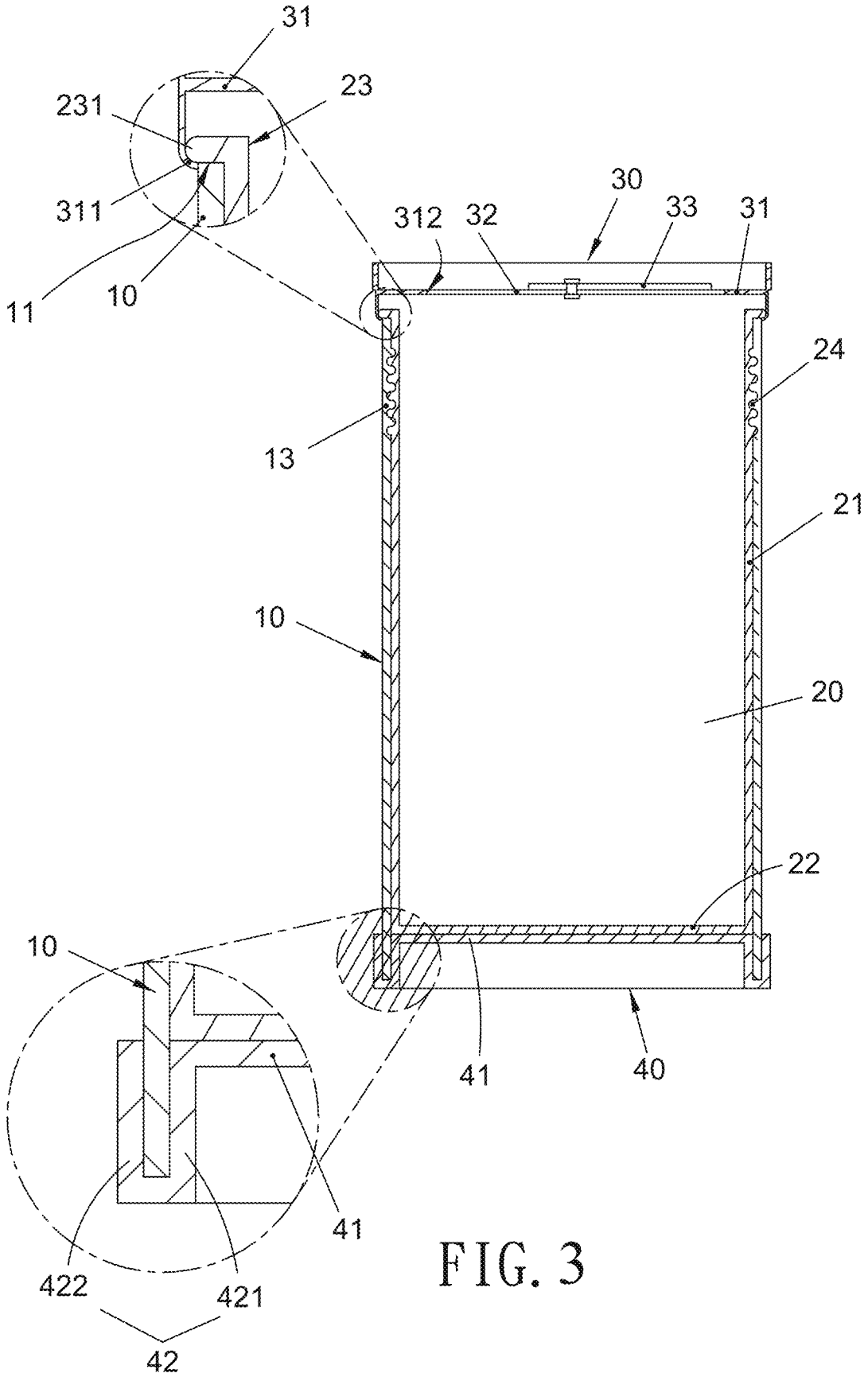
FIG. 3 is a sectional view of the embodiment in FIG. 2 according to the present invention.

The inner container 20 which is basically a waterproof container is mounted into the housing 10 and is composed of a tubular side wall 21, a bottom surface 22 located at a bottom of the side wall 21 and integrally connected to the side wall 21, an inner opening 23 formed on a top end of the side wall 21 and provided with a flange 231 projecting outward, and a second connection portion 24 disposed on an outer wall surface of the side wall 21 and used for connection with the first connection portion 13. In a preferred embodiment, the flange 231 is at a higher level than the top opening 11 of the housing 10 (as shown in FIG. 3) after the inner container 20 being mounted into the housing 10. The first connection portion 13 and the second connection portion 24 are threads (but not limited) by which the inner container 20 is fixed in the housing 10. Thereby the housing 10 and the inner container 20 are easily disassembled to be recycled and reused. In another embodiment, the first connection portion 13 and the second connection portion 24 can be a projection and a corresponding slot able to be locked with or separated from each other fast. People having ordinary skill in the art can easily implement or replace the first and the second connection portions 13, 24.

In a preferred embodiment, the inner container 20 is made of a kind of bio polyester, bio-based polyethylene 2,5-furanoate (PEF), by blow molding. The material used for the inner container 20 is PET and a blank is produced by injection molding. Then the blank is produced into the inner container 20 with an inner space by blow molding. Food or its ingredients are stored in the inner container 20 to keep freshness by waterproofness and air-tightness of the inner container 20.

The easy-open lid 30 made of aluminum is for sealing or opening the inner opening 23 of the inner container 20 and composed of an aluminum lid 31, an open plate 32, and a pull-tab 33. The aluminum lid 31 consists of a circular skirt 311 located at a periphery of the aluminum lid 31 and used for covering the flange 231 of the inner container 20 (as shown in FIG. 3) so that the easy-open lid 30 is assembled with the inner container 20 and the inner opening 23 is sealed. The aluminum lid 31 is provided with an opening 312 which is normally closed by the open plate 32. While being pulled by an external force, the pull-tab 33 which is connected to one end of the open plate 32 drives the open plate 32 to come off from the aluminum lid 31 so that the opening 312 is exposed. The size of the opening 312 depends on the uses of the present container. In a preferred embodiment, the opening 312 can be a smaller opening of a pull-tub can, used to pour liquids out of the pull-tub can. In another embodiment, the size of the opening 312 can be maximized to be almost as large as the size of the inner opening 23 in order to pour food or ingredients out of the inner container 20 quickly and conveniently.

The bottom cover 40 is made of biodegradable plastic. In a preferred embodiment, the biodegradable plastic is bio-polyester PEF or poly (butylene succinate (PBS) which is produced into the bottom cover 40 by injection molding. In a preferred embodiment, the bottom cover 40 is detachably connected to the bottom opening 12 of the housing 10.

Refer to FIG. 2 and FIG. 3, in a preferred embodiment, the bottom cover 40 consists of a bottom plate 41 and a circular wall 42 arranged at a periphery of the bottom plate 41. The circular wall 42 is composed of an inner wall 421 and an outer wall 422. A bottom of the inner wall 421 and a bottom of the outer wall 422 are integrally connected to form one part (as shown in FIG. 3). A radial section of the circular wall 42 is U-shaped and a gap G is formed between the inner wall 421 and the outer wall 422 for allowing the bottom end of the housing 10 to insert and mounted in the gap G.

Figure 4:
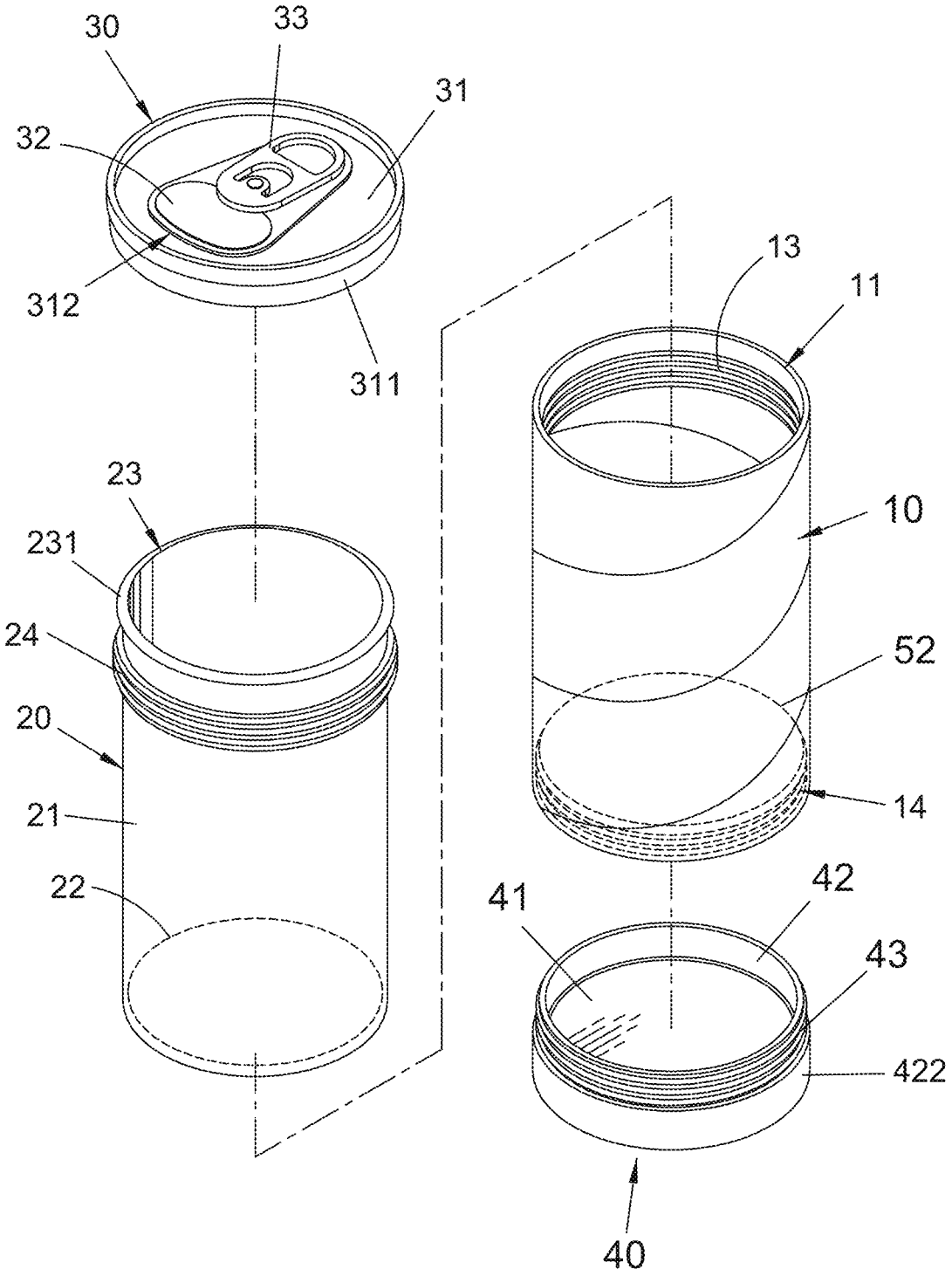
FIG. 4 is an exploded view of another embodiment according to the present invention.

Refer to FIG. 4, in another embodiment, the bottom cover 40 is detachably connected to the bottom opening 12 of the housing 10 by threads. A first thread 43 and a second thread 14 are respectively arranged at an outer surface of the circular wall 42 of the bottom cover 40 and an inner wall surface of the housing 10 close to the bottom opening 12. The first thread 43 and the second thread 14 are able to engage with each other.

A method of manufacturing an environmentally friendly fresh-keeping can according to the present invention includes the following steps. First preparing an easy-open lid 30 made of aluminum and composed of an aluminum lid 31, an open plate 32, and a pull-tab 33. A periphery of the aluminum lid 31 is provided with a circular skirt 311. Then preparing a housing 10 which is formed by a spiral paper tube. A top opening 11 and a bottom opening 12 are respectively formed on a top end and a bottom end of the housing 10. An inner wall surface of the housing 10 is provided with a first connection portion 13. Next using biodegradable plastic to prepare a bottom cover 40. Later using bio-based polyethylene 2,5-furanoate (PEF) to produce an inner container 20 by blow molding. The inner container 20 is composed of a tubular side wall 21, a bottom surface 22 located at a bottom of the side wall 21 and integrally connected to the side wall 21, an inner opening 23 formed on a top end of the side wall 21 and provided with a flange 231 projecting outward, and a second connection portion 24 disposed on an outer wall surface of the side wall 21 and used for connection with the first connection portion 13. Then mounting the inner container 20 into the housing 10 and the flange 231 is at a higher level than the top opening 11 of the housing 10. The first connection portion 13 of the housing 10 and the second connection portion 24 of the inner container 20 are connected with each other. Later detachably connecting the bottom cover 40 to the bottom opening 12 of the housing 10 for sealing the bottom opening 12. Lastly covering the flange 231 of the inner container 20 with the circular skirt 311 of the easy-open lid 30 so that the easy-open lid 30 is assembled with the inner container 20 to seal the inner opening 23.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalent.

The invention claimed is:

1. An environmentally friendly fresh-keeping can comprising:

a housing formed by a spiral paper tube and provided with a top opening disposed on a top end of the housing, a bottom opening disposed on a bottom end of the housing, and a first connection portion arranged at an inner wall surface of the housing;

an inner container which is a waterproof container mounted into the housing and composed of a tubular side wall, a bottom surface located at a bottom of the side wall and integrally connected to the side wall, an inner opening formed on a top end of the side wall and provided with a flange projecting outward, and a second connection portion disposed on an outer wall surface of the side wall and used for connection with the first connection portion; the flange located at a level higher than a level of the top opening of the housing;

an easy-open lid made of aluminum and used for sealing or opening the inner opening of the inner container; the easy-open lid provided with an aluminum lid, an open plate, and a pull-tab; the aluminum lid composed of a circular skirt located at a periphery of the aluminum lid for covering the flange of the inner container, and an opening normally closed by the open plate; after the circular skirt covering the flange of the inner container, the easy-open lid being assembled with the inner container to seal the inner opening; the pull-tab connected to one end of the open plate for driving the open plate to come off from the aluminum lid while the pull-tab being pulled by an external force so that the opening is exposed; and a bottom cover made of biodegradable plastic by injection molding and able to be detachably connected to the bottom opening of the housing.

2. The environmentally friendly fresh-keeping can as claimed in claim 1, wherein the spiral paper tube used to form the housing is produced by waterproof paper being wound spirally.

3. The environmentally friendly fresh-keeping can as claimed in claim 2, wherein the waterproof paper is formed by at least two layers of fiber paper and provided with a waterproof layer disposed on a surface of the waterproof paper and located at the inner wall surface of the spiral paper tube.

4. The environmentally friendly fresh-keeping can as claimed in claim 3, wherein fiber extension directions of the two layers of fiber paper cross each other.

5. The environmentally friendly fresh-keeping can as claimed in claim 1, wherein the inner container is made of bio-based polyethylene 2,5-furanoate (PEF) and produced by blow molding.

6. The environmentally friendly fresh-keeping can as claimed in claim 1, wherein the first connection portion and the second connection portion are threads.

7. The environmentally friendly fresh-keeping can as claimed in claim 1, wherein the bottom cover includes a bottom plate and a circular wall arranged at a periphery of the bottom plate; the circular wall is composed of an inner wall and an outer wall; a bottom of the inner wall and a bottom of the outer wall are integrated into one part; a radial section of the circular wall is U-shaped and a gap is formed between the inner wall and the outer wall for allowing the bottom end of the housing to insert and mount in the gap.

8. A method of manufacturing an environmentally friendly fresh-keeping can comprising the steps of:

preparing an easy-open lid which is made of aluminum and composed of an open plate, a pull-tab, and an aluminum lid provided with a circular skirt on a periphery of the aluminum lid;

preparing a housing formed by a spiral paper tube and having a top opening disposed on a top end of the housing, a bottom opening disposed on a bottom end of the housing, and a first connection portion arranged at an inner wall surface of the housing;

using biodegradable plastic to prepare a bottom cover;

using bio-based polyethylene 2,5-furanoate (PEF) to produce an inner container by blow molding; the inner container having a tubular side wall, a bottom surface located at a bottom of the side wall and integrally connected to the side wall, an inner opening formed on a top end of the side wall and provided with a flange projecting outward, and a second connection portion disposed on an outer wall surface of the side wall and used for connection with the first connection portion;

mounting the inner container into the housing and the flange located at a level higher than a level of the top opening of the housing; the second connection portion of the inner container and the first connection portion of the housing connected with each other;

detachably connecting the bottom cover to the bottom opening of the housing for sealing the bottom opening; and covering the flange of the inner container with the circular skirt of the easy-open lid so that the easy-open lid is assembled with the inner container to seal the inner opening.

9. The method as claimed in claim 8, wherein the method further includes a step of spirally winding waterproof paper having at least two layers of fiber paper into the spiral paper tube; the waterproof paper is provided with a waterproof layer disposed on a surface of the waterproof paper and located at the inner wall surface of the spiral paper tube.

10. The method as claimed in claim 9, wherein fiber extension directions of the two layers of fiber paper cross each other.

11. The method as claimed in claim 8, wherein the first connection portion and the second connection portion are threads.

12. The method as claimed in claim 8, wherein the bottom cover includes a bottom plate and a circular wall arranged at a periphery of the bottom plate; the circular wall is composed of an inner wall and an outer wall; a bottom of the inner wall and a bottom of the outer wall are integrated into one part; a radial section of the circular wall is U-shaped and a gap is formed between the inner wall and the outer wall for allowing the bottom end of the housing to insert and mount in the gap.

13. The method as claimed in claim 8, wherein the aluminum lid having an opening normally closed by the open plate; the pull-tab is connected to one end of the open plate for driving the open plate to come off from the aluminum lid while the pull-tab being pulled by an external force so that the opening is exposed.

* * * * *